US005873315A

United States Patent [19]

Codos

[11] Patent Number: 5,873,315

[45] Date of Patent: Feb. 23, 1999

[54] COMBINATION PRINTING AND QUILTING METHOD AND APPARATUS

[75] Inventor: Richard N. Codos, Warren, N.J.

[73] Assignee: L&P Property Management Company, South Gate, Calif.

[21] Appl. No.: 70,948

[22] Filed: May 1, 1998

[51] Int. Cl.[6] ..... D05B 11/00; D05B 21/00

[52] U.S. Cl. ..... 112/117; 112/470.05; 112/470.13; 112/475.08; 112/475.19; 101/35

[58] Field of Search ..... 112/117, 118, 112/119, 470.05, 470.12, 470.13, 470.06, 470.36, 470.33, 304, 320, 475.08, 475.19; 101/288, 219, 35

[56] References Cited

U.S. PATENT DOCUMENTS

| | | | |
|---|---|---|---|
| 3,611,961 | 10/1971 | Lopez et al. | 112/470.05 |
| 3,960,095 | 6/1976 | Story . | |
| 4,748,920 | 6/1988 | Stutznacker | 112/119 X |
| 4,785,750 | 11/1988 | Best . | |
| 4,860,675 | 8/1989 | Brower et al. . | |
| 4,953,485 | 9/1990 | Brower et al. . | |
| 5,018,416 | 5/1991 | Freerman . | |
| 5,022,323 | 6/1991 | Schultheis | 101/219 |
| 5,040,473 | 8/1991 | Zesch et al. . | |
| 5,095,835 | 3/1992 | Jernigan et al. . | |
| 5,099,773 | 3/1992 | Codos | 112/475.19 |
| 5,144,899 | 9/1992 | Allen | 112/475.19 X |
| 5,154,130 | 10/1992 | Gribetz et al. . | |
| 5,544,599 | 8/1996 | Frazer et al. . | |
| 5,685,250 | 11/1997 | Kaetterhenry et al. . | |

*Primary Examiner*—Peter Nerbun
*Attorney, Agent, or Firm*—Wood, Herron & Evans, L.L.P.

[57] ABSTRACT

A quilting machine is provided having a quilting station and a printing station located upstream of the quilting station, with a conveyor extending through each of the stations to convey a web of quilting material through the machine. At the printing station a top layer is printed with a multi-colored design under the control of a programmed controller, which may vary the design from section to section of the web so that individual or small quantities of panel sections of the web may be decorated with a different pattern. The conveyor maintains precise longitudinal position information of the location of the printed pattern and conveys the top patterned layer web through a drying station. Then, after combining the top layer web with webs of filler and backing material, it conveys the multi-layered web to the quilting station where a quilted pattern is caused by the controller to be sewn on the printed pattern bearing material in registration with the printed pattern. A cutoff station separates the web panels bearing composite printed and quilted patterns under control of the programmed controller.

12 Claims, 1 Drawing Sheet

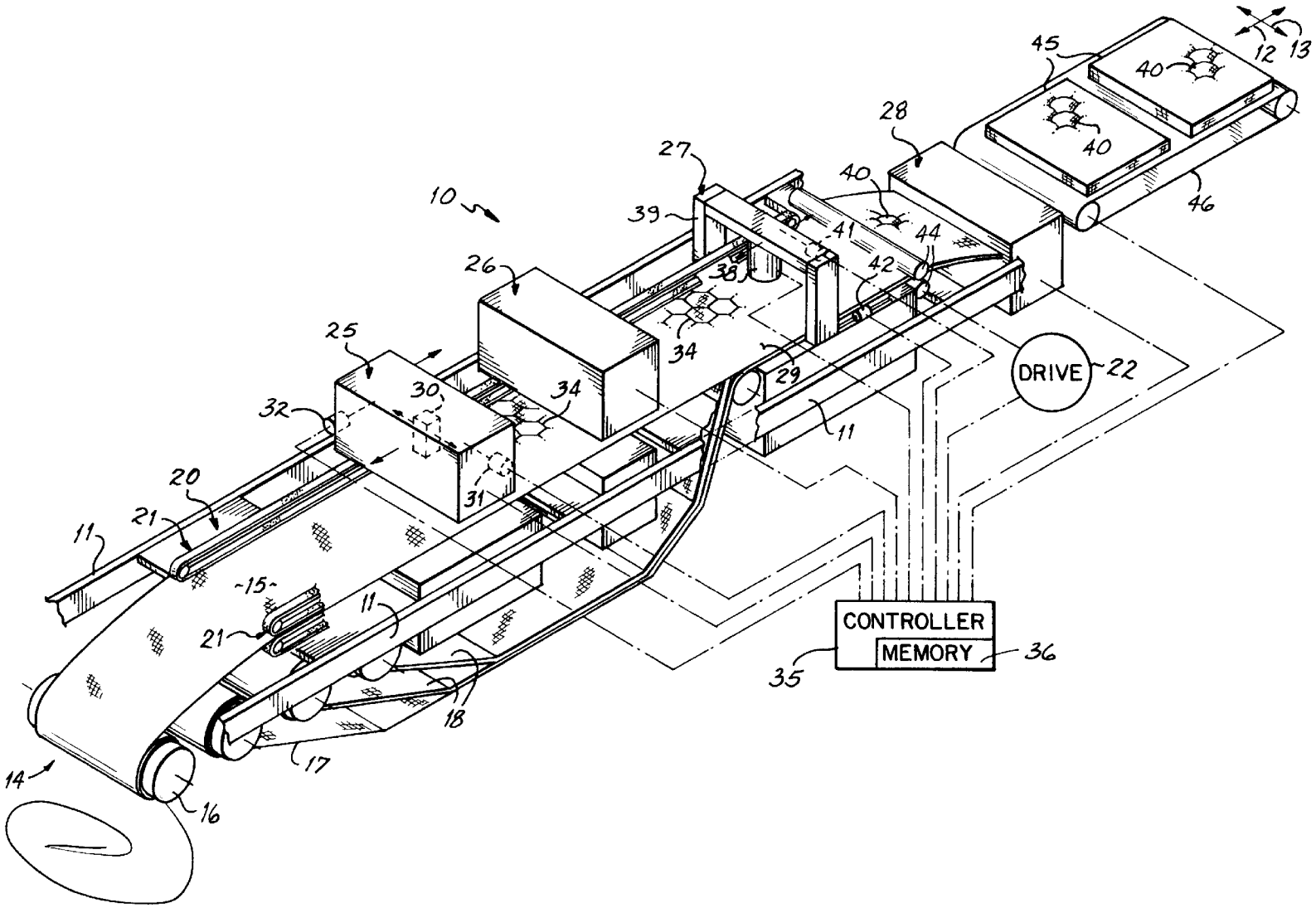
DRIVE
CONTROLLER
MEMORY

COMBINATION PRINTING AND QUILTING METHOD AND APPARATUS

The present invention relates to the quilting, and particularly to the quilting of patterns on multiple layer materials such as mattress covers, comforters, bedspreads and the like, especially composite patterns in which the overall appearance of the quilted product includes a combination of printed and quilted features.

BACKGROUND OF THE INVENTION

Quilting is a special art in the general field of sewing in which patterns are stitched through a plurality of layers of material over a two dimensional area of the material. The multiple layers of material normally include at least three layers, one a woven primary or facing sheet that will have a decorative finished quality, one a usually woven backing sheet that may or may not be of a finished quality, and one or more internal layers of thick filler material, usually of randomly oriented fibers. The stitched patterns maintain the physical relationship of the layers of material to each other as well as provide ornamental qualities. In quilting, two different approaches are generally used.

Single needle quilters of the type illustrated and described in U.S. patent application Ser. No. 08/497,727, filed Jun. 30, 1995 U.S. Pat. No. 5,640,916 and entitled Quilting Method and Apparatus and those patents cited and otherwise referred to therein are customarily used for the stitching of most comforters, some bedspreads and other products from preformed or precut rectangular panels. Some single needle quilters are used to quilt patterns on fabric that carries a pre-woven or printed pattern, with the quilting adding to or enhancing the appearance of the pattern. Such quilters require that pre-patterned material be manually positioned in the quilting apparatus so that the quilting can be registered with the pre applied pattern or a complicated visual positioning system be used. With such systems, border quilting or coarse pattern quilting can be achieved but high quality outline quilting around the pre applied patterns or the quilting of pattern details of a fraction of an inch in scale are difficult to achieve. Single needle quilters are usually lock stitch machines.

Multiple needle quilters of the type illustrated in U.S. Pat. No. 5,154,130 are customarily used for the stitching of mattress covers, some bedspreads and other such products which are commonly formed from multi-layered web fed material. These multi-needle quilters include banks of mechanically ganged needles that sew multiple copies of a recurring pattern on the fabric. With such multi-needle machines, the combining of quilting with pre-applied printed or woven patterns in the fabric which would require registration of the quilting with the pre-applied patterns is usually not attempted. Multi-needle quilters are usually chain stitch machines.

Another quilting apparatus employing some of the characteristics of both single needle panel type quilters and web fed multi-needle quilters is that disclosed in U.S. patent application Ser. No. 08/831,060 to Jeff Kaetterhenry, et al. and entitled Web-fed Chain-stitch Single-needle Mattress Cover Quilter with Needle Deflection Compensation. Such a machine uses one or more separately controllable single needle heads that apply chain stitches to panels or webs.

The outer layer of material used for mattress covers, often referred to as ticking, is supplied in a variety of colors and preprinted or dyed patterns. Generally, mattress manufacturers who are the customers of the quilted mattress cover manufacturers or quilting machinery manufacturers require a wide variety of ticking material patterns to produce a variety of bedding products. Frequently, small quantities of each of the variety of products must be made to supply their customers' requirements, requiring the maintenance of inventories of a large number of different patterns of ticking material, which involves substantial cost. Further, the need to constantly change ticking supply rolls when manufacturing such a variety of products in small quantities is a major factor in reducing throughput of the mattress making process and delaying production. This problem exists in the manufacture of bedspreads, comforters and other quilted products where a variety of products in small quantities is desired.

There exists a need in mattress cover manufacturing for a capability of efficiently producing small quantities of quilted fabric such as mattress covers, comforters, bedspreads and the like where different pre-applied patterns on the product are desired to be enhanced by combining the pre-applied and quilted patterns, particularly where combinations of quilted patterns and printed or other pre-applied patterns must vary with each or every few products.

SUMMARY OF THE INVENTION

An objective of the present invention is to provide mattress cover manufacturers with the ability to produce quilted products having a wide variety of patterns that include both quilting and printed or other pre-applied images or designs without the need to inventory material in a large number of different pre-applied designs.

A further objective of the invention is to provide for the intricate outline quilting of pre-applied designs on multi-layered materials in a highly efficient, economical, high speed and automated manner.

Another objective of the present invention is to efficiently provide for customizable printed and quilted patterns on mattress covers, bedspreads and the like, which can be varied in small quantities or on an individual basis.

It is a particular objective of the present invention to reduce quilting downtime due to the need to make ticking or other material changes.

It is a more particular objective of the present invention to provide a quilting method and apparatus with which quilted patterns and printed patterns may be applied in registration and varied on a quilting machine.

According to the principles of the present invention, there is provided a quilting apparatus having a supply of multiple layers of material and in which an outer or top layer is fed, preferably as a continuous web, through a series of stations at which a printed pattern is first applied to the top layer and then a quilted pattern is subsequently applied to the multiple layers of material in registration with the printed pattern or design. An apparatus is provided that includes a printing station located on a frame and quilting station located on the frame, preferably downstream from the printing apparatus. A material conveyer is provided that brings fabric printed at the printing station into the quilting station with the location of the printed pattern known so that one or more quilting heads at the quilting station can be registered with the printed pattern.

According to a preferred embodiment of the invention, the printing station includes one or more ink-jet printing or dye transfer heads moveable under computer control over the outer or facing layer of material. Additional layers of material are combined with the outer layer, preferably downstream of the printing station and after a printed pattern is applied to the outer layer at the printing station. At the quilting station the quilted pattern is quilted onto the material, in registration with the printed pattern. The registration is preferably achieved by maintaining information in a controller of the location of the printed pattern on a facing material web that moves through the printing station. Preferably, information of the location of the pattern on the web is maintained as the web moves from the printing station, as the other web layers of material are brought into contact with the web of outer material, and as the webs are fed to the quilting station. For example, outline quilting the pattern in computer controlled registration with the printed pattern can be carried out based on the maintained registration information of the pattern on the web moving through the apparatus.

In one preferred embodiment of the invention, exact registration of the design that is printed onto the material with the quilted pattern is maintained by holding a panel of the multi-layered material onto which the pattern is printed in a framed condition at and between the printing and quilting stations. The registration is preferably maintained throughout the entire printing and quilting operation by side securements such as, for example, a pin-tentering material transport that keeps the material in registration through the printing process, the quilting process, and an intermediate drying process. Computer or programmed processor control operates the transport in synchronization with the printing head control and the quilting head control so that the printed and quilted patterns are applied in precise registration.

In certain embodiments of the invention, vision systems may be employed to determine or verify the location of the printed pattern and to enhance or provide registration of the quilting with the printing, in addition or in the alternative to the computer control of the material transport.

In the preferred embodiments of the invention, printed patterns or designs and the quilted patterns are programmed or stored in memory and, in a programmed or operator selected manner, printed designs and quilted patterns may be combined in different combinations to produce a wide variety of composite printed and quilted patterns.

The present invention provides the ability to change printed patterns in the course of a quilting run, and to change both printed and quilted patterns to produce quilted products in a wide variety of composite patterns. With the invention, the number of base cloth supplies required to provide pattern variety is greatly reduced, saving substantial costs to the quilted product manufacturer. With the invention, the appearance of the outer layer can be embellished to provide variety and detail, and outline quilting can be carried out in high quality and in close proximity to the printed design. Further, with the invention, these advantages are available with both single needle and multiple needle quilters.

These and other objects of the present invention will be more readily apparent from the following detailed description of the drawings.

BRIEF DESCRIPTION OF THE DRAWINGS

The FIGURE is a diagrammatic perspective view of a web-fed mattress cover quilting machine embodying principles of the present invention.

DETAILED DESCRIPTION OF THE PREFERRED EMBODIMENT

The FIGURE illustrates a quilting machine 10 having a stationary frame 11 with a longitudinal extent represented by arrow 12 and a transverse extent represented by arrow 13. The machine 10 has a front end 14 into which is advanced a web 15 of ticking or facing material from a supply roll 16 rotatably mounted to the frame 11. A roll of backing material 17 and one or more rolls of filler material 18 are also supplied in web form on rolls also rotatably mounted to the frame 11. The webs are directed around a plurality of rollers (not shown) onto a conveyor or conveyor system 20, each at various points along the conveyor 20. The conveyor system 20 preferably includes a pair of opposed pin tentering belt sets 21 which extend through the machine 10 and onto which the outer layer 15 is fed at the front end 14 of the machine 10. The belt sets 21 retain the web 15 in a precisely known longitudinal position thereon as the belt sets 21 carry the web 15 through the longitudinal extent of the machine 10, preferably with an accuracy of 0 to ¼ inch. The longitudinal movement of the belt 20 is controlled by a conveyor drive 22. The conveyor 20 may take the alternative forms including but not limited to opposed cog belt side securements, longitudinally moveable positive side clamps that engage and tension the material of the web 15 or other securing structure for holding the facing material web 15 fixed relative to the conveyor 20.

Along the conveyor 20 are provided three stations, including a printing station 25, a drying station 26, a quilting station 27 and a panel cutting station 28. The backing material 17 and filler material 18 are brought into contact with the top layer 15 between the drying station 26 and the quilting station 27 to form a multi-layered material 29 for quilting at the quilting station 27. Preferably, the layers 17 and 18 are not engaged by the belt sets 21 of the conveyor 20 but rather are brought into contact with the bottom of the web 15 upstream of the quilting station 27 to extend beneath the web 15 through the quilting station 27 and between a pair of pinch rollers 44 at the downstream end of the quilting station 27. The rollers 44 operate in synchronism with the belt sets 21 and pull the webs 17 and 18 through the machine 10 with the web 15.

The printing station 25 includes one or more printing heads 30 that are transversely moveable across the frame 11 and may also be longitudinally moveable on the frame 11 under the power of a transverse drive 31 and an optional longitudinal drive 32. Alternatively, the head 30 may extend across the width of the web 15 and be configured to print an entire transverse line of points simultaneously onto the web 15. The head 30 is provided with controls that allow for the selective operation of the head 30 to selectively print two dimensional designs 34 of one or more colors onto the top layer web 15. The drive 22 for the conveyor 20, the drives 31 and 32 for the print heads 30 and the operation of the head 30 are program controlled to print patterns at known locations on the web 15 by a controller 35, which includes a memory 36 for storing programmed patterns, machine control programs and real time data regarding the nature and longitudinal and transverse location of printed designs on the web 15 and the relative longitudinal position of the web 15 in the machine 10.

The drying station 26 is fixed to the frame 11. The drying station may be of whatever configuration is suitable to effectively dry the dye being applied at the printing station 25. It may operate continuously or be selectively controlled in accordance with the pattern, as is appropriate. While the print head 30 is preferably a digital dot printer in which the coordinates of each dot of the image printed is capable of being precisely located on the web 15 and relative to the conveyor 20, screen printed, roll printed or other types of printed images may be used while still realizing some of the advantages of the invention.

The quilting station 27 is, in the preferred embodiment, a single needle quilting station such as is described in U.S. patent application Ser. No. 08/831,060 to Jeff Kaetterhenry, et al. and entitled Web-fed Chain-stitch Single-needle Mattress Cover Quilter with Needle Deflection Compensation, which is expressly incorporated by reference herein. Other suitable single needle type quilting machines with which the present invention may be used are disclosed in U.S. patent application Ser. No. 08/497,727, filed Jun. 30, 1995 U.S. Pat. No. 5,640,916 and entitled Quilting Method and Apparatus, expressly incorporated by reference herein. The quilting station 27 may also include a multi-needle quilting structure such as that disclosed in U.S. Pat. No. 5,154,130, also expressly incorporated by reference herein. In the FIGURE, a single needle quilting head 38 is illustrated which is transversely moveable on a carriage 39 which is longitudinally moveable on the frame 11 so that the head 38 can stitch 360° patterns on the multi-layered material 29.

The controller 35 controls the relative position of head 38 relative to the multi-layered material 29, which is maintained at a precisely known position by the operation of the drive 22 and conveyor 20 by the controller 35 and through the storage of positioning information in the memory 36 of the controller 35. In the quilting station 27, the quilting head 38 quilts a stitched pattern in registration with the printed pattern 34 to produce a combined or composite printed and quilted pattern 40 on the multi-layered web 29. This may be achieved, as in the illustrated embodiment by holding the assembled web 29 stationary in the quilting station 27 while the head 38 moves both transversely, under the power of a transverse linear servo drive 41, and longitudinally on the frame 11, under the power of a longitudinal servo drive 42, to stitch the 360° pattern by driving the servos 41 and 42 in relation to the known position of the pattern 34 by the controller 35 based on information in its memory 36. Alternatively, the needles of a single or multi-needle quilting head may be moved relative to the web 29 by moving the quilting head 38 only transversely relative to the frame 11 while moving the web 29 longitudinally relative to the quilting station 27, under the power of conveyor drive 22, which can be made to reversibly operate the conveyor 20 under the control of the controller 35.

The cutoff station 28 is located downstream of the downstream end of the conveyor 20. The cutoff station 28 is also controlled by the controller 35 in synchronism with the quilting station 27 and the conveyor 20, and it may be controlled in a manner that will compensate for shrinkage of the multi-layered material web 29 during quilting at the quilting station 27, or in such other manner as described and illustrated in U.S. Pat. No. 5,544,599 entitled Program Controlled Quilter and Panel Cutter System with Automatic Shrinkage Compensation, hereby expressly incorporated by reference herein. Information regarding the shrinkage of the fabric during quilting, which is due to the gathering of material that results when thick filled multi-layer material is quilted, can be taken into account by the controller 35 when quilting in registration with the printed pattern 34. The panel cutter 28 separates individual printed and quilted panels 45 from the web 38, each bearing a composite printed and quilted pattern 40. The cut panels 45 are removed from the output end of the machine by an outfeed conveyor 46, which also operates under the control of the controller 35.

The above description is representative of certain preferred embodiments of the invention. Those skilled in the art will appreciate that various changes and additions may be made to the embodiments described above without departing from the principles of the present invention.

I claim:

1. A quilting apparatus comprising:

a frame;

a conveyor moveable longitudinally relative to the frame;

a quilting station located along the conveyor and having at least one needle on at least one quilting head that is moveable both longitudinally and transversely relative to the conveyor and at least transversely relative to the frame;

securing structure for holding a web of facing material fixed relative to the conveyor;

a printing station located along the conveyor upstream of the quilting station and having at least one printing head operable to print designs on the web of facing material;

guides directing the web of facing material onto the conveyor upstream of the printing station and webs of backing and filling material onto the conveyor between the printing station and quilting station; and a controller for controlling the movement of the at least one printing head, the quilting head and conveyor and the operation of the at least one printing head and quilting head in relation to the position of the conveyor and the location of the web of facing material on the conveyor in accordance with programmed print designs and quilt patterns, and for coordinating the heads and conveyor to produce a composite printed and quilted pattern on the material with patterns quilted on the material at the quilting station in registration with designs printed on the material at the print station.

2. The apparatus of claim 1 wherein:

the printing head is moveable both longitudinally and transversely relative to the conveyor and at least transversely relative to the frame.

3. The apparatus of claim 1 wherein:

the printing head is an ink jet printing head operable to print a design on material at the printing station that is composed of dots printed at programmed locations on the material.

4. The apparatus of claim 1 wherein:

the quilting station includes a single needle quilter and the quilting head is a single needle quilting head moveable relative to the conveyor.

5. The apparatus of claim 1 wherein the quilting station includes a multi-needle quilting station operable to simultaneously chain stitch a plurality of patterns of an array onto material at the quilting station.

6. A quilting apparatus comprising:

a conveyor for moving material to be quilted through the apparatus;

a quilting station located along the conveyor and having at least one needle on at least one quilting head that is moveable both longitudinally and transversely relative to the material on the conveyor;

a printing station located along the conveyor upstream of the quilting station and having at least one printing head operable to print designs on the web of facing material; and a controller configured to operate the at least one printing head to print onto each of a plurality of panels of material in accordance with a selected design, to operate the quilting head to quilt a quilted pattern onto each of the plurality of panel lengths of the material in accordance with a selected pattern, and to independently change the printed designs and quilted patterns from one panel length to another panel length.

7. The apparatus of claim 1 wherein:

the printing head is moveable both longitudinally and transversely relative to the conveyor and at least transversely relative to the frame.

8. The apparatus of claim 1 wherein:

the controller is configured to quilt the patterns in registration with the printed designs.

9. A quilting apparatus comprising:

a conveyor for moving material to be quilted through the apparatus;

a quilting station located along the conveyor and having at least one needle on at least one quilting head that is moveable transversely relative to the material on the conveyor;

a printing station located along the conveyor upstream of the quilting station and having at least one printing head that is moveable transversely relative to material on the conveyor; and a programmed controller for controlling operation of the printing head to print a printed pattern onto each of a plurality of panels of material in accordance with a selected design and for controlling the operation of the quilting head to quilt a quilted pattern onto each of the plurality of panels of the material in accordance with a selected pattern and in registration with the printed pattern, said programmed controller being operable to change the printed patterns and quilted patterns from panel to panel.

10. A quilting method comprising the steps of:

moving material on a conveyor through a printing station;

selecting a first print pattern to be printed on the material;

controlling the printing head at the printing station with a controller to print the selected print pattern onto the material at a location on the material;

moving the material from the printing station to a quilting station and determining the position of the printed pattern at the quilting station that corresponds to the location of the printed pattern on the material;

selecting a first quilt pattern to be quilted on the material;

controlling a quilting head at the quilting station with the controller to quilt the selected quilt pattern onto the material bearing the printed pattern.

11. The method of claim 10 wherein:

the controlling step includes the step of controlling the quilting head at the quilting station with the controller to quilt a quilt pattern onto the material in registration with the printed pattern.

12. The method of claim 10 wherein the material is moved onto the conveyor from a continuous web supply, and the method further comprises the steps of:

selecting a second print pattern and, without changing the material;

moving an additional length of the material from the web supply through the printing station;

controlling the printing head at the printing station with the controller to print the selected second print pattern onto the material at a location on the material;

moving the material from the printing station to the quilting station and determining the position of the printed pattern at the quilting station that corresponds to the location of the second printed pattern on the material;

controlling the quilting head at the quilting station with the controller to quilt a quilt pattern onto the material in registration with the printed pattern.

* * * * *

UNITED STATES PATENT AND TRADEMARK OFFICE

CERTIFICATE OF CORRECTION

PATENT NO. : 5,873,315

DATED : Feb. 23, 1999

INVENTOR(S) : Codos

It is certified that error appears in the above-indentified patent and that said Letters Patent is hereby corrected as shown below:

In the Claims

In claim 9, column 7, line 21, before "printing", insert --at least one--;

Signed and Sealed this

Twenty-seventh Day of July, 1999

*Attest:*

Q. TODD DICKINSON

*Attesting Officer*

*Acting Commissioner of Patents and Trademarks*